United States Patent [19]

Thompson

[11] Patent Number: 5,048,316

[45] Date of Patent: Sep. 17, 1991

[54] PRESSURE POT SHOT PEENING SYSTEM HAVING A HOLDER

[75] Inventor: Robert A. Thompson, New York, N.Y.

[73] Assignee: General Electric Company, Schenectady, N.Y.

[21] Appl. No.: 646,901

[22] Filed: Jan. 28, 1991

[51] Int. Cl.[5] ..... B24C 7/00

[52] U.S. Cl. ..... 72/19; 72/53; 51/439; 51/319; 73/11

[58] Field of Search ..... 72/53, 8, 10, 19; 29/90.7; 73/11, 861.72, 861.73, 861.71, 865.9, 198; 51/319, 415, 436, 438, 439

[56] References Cited

U.S. PATENT DOCUMENTS

| | | | |
|---|---|---|---|
| 2,538,785 | 1/1951 | Karig | 73/861.71 |
| 4,470,292 | 9/1984 | DeClark et al. | 72/861.73 |
| 4,487,044 | 12/1984 | Fapiano | 72/8 |
| 4,805,429 | 2/1989 | Thompson | 72/53 |
| 4,848,123 | 7/1989 | Thompson | 72/53 |
| 4,873,855 | 10/1989 | Thompson | 72/53 |

*Primary Examiner*—David Jones

*Attorney, Agent, or Firm*—James R. McDaniel; James C. Davis, Jr.; Paul R. Webb, II

[57] ABSTRACT

A nozzle holder and sensor for a pressure pot peening system is disclosed. The holder includes a 90° bend which is provided so that substantially the entire momentum of the mass of shot and air ejected from the nozzle can be sensed by the sensor and mass of shot and air ejected is not adversely affected if the hose from the shot peening system is moved. Also the holder can be oriented into a variety of positions and locations.

6 Claims, 1 Drawing Sheet

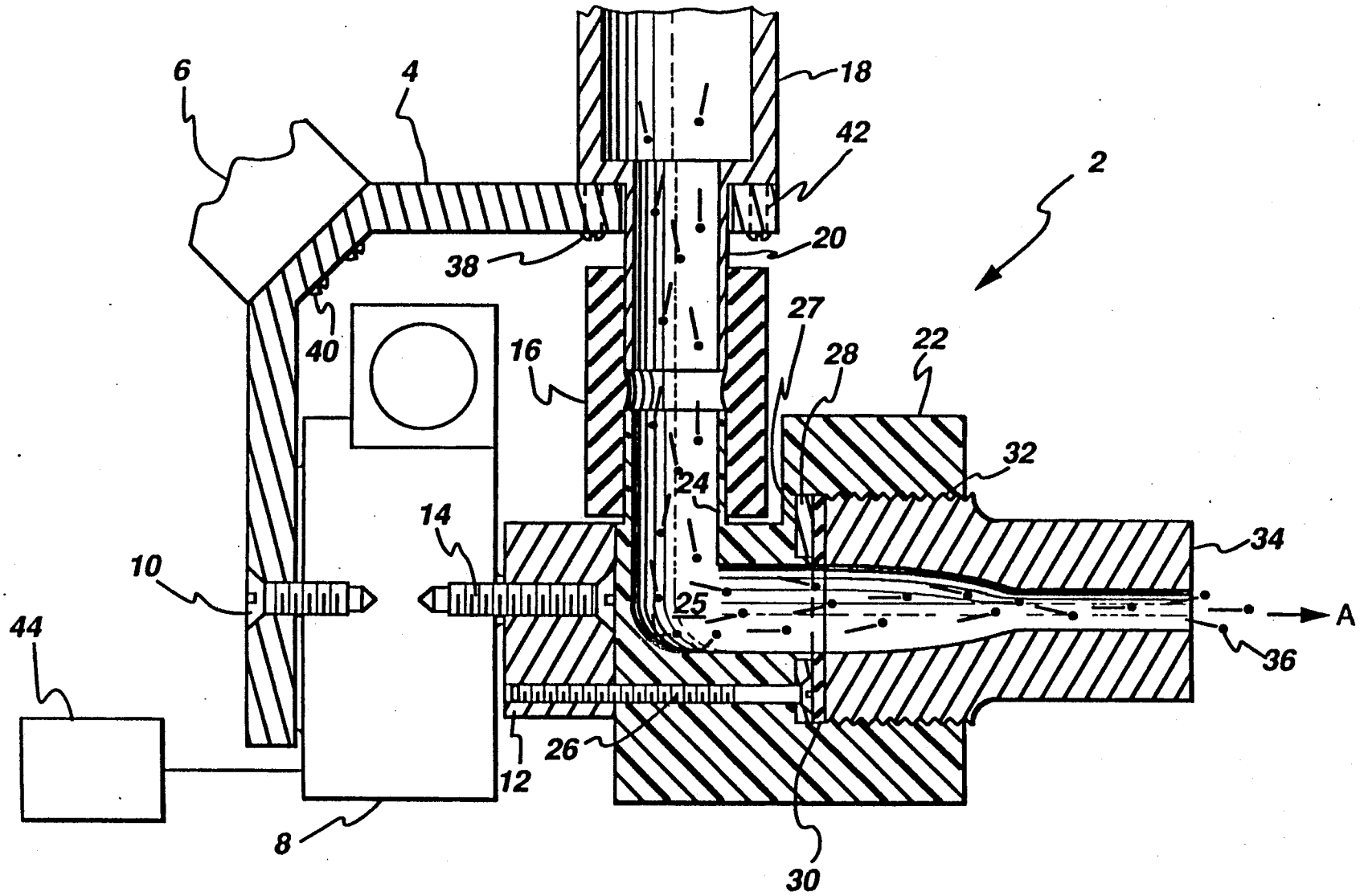
2
4
6
8
10
12
14
16
18
20
22
24
25
26
27
28
30
32
34
36
38
40
42
44
A

PRESSURE POT SHOT PEENING SYSTEM HAVING A HOLDER

BACKGROUND OF THE INVENTION

This invention relates to pressure pot shot peening systems of the type that have nozzle holder assemblies constructed of several individual pieces, which are rigidly attached together form an integral structure. Such structure of this type generally provide support for the nozzle and also allow a sensor to be positioned adjacent to the nozzle to measure only those forces exerted against the nozzle and parallel to the direction of elongation of the nozzle. In particular, a shot peening nozzle from a pressure pot peening system having a 90° bend in the nozzle is secured to a bracket an a force sensor is secured adjacent to the bend and in alignment with the longitudinal axis of the shot flow emitted from the nozzle such that the bracket supports the area around the 90° bend in the nozzle and the sensor detects only those forces acting on the nozzle in that longitudinal direction. This invention relates to certain unique nozzle holders for shot peening operations using a pressure pot peening device and the shot velocity sensor means in association therewith.

It is known, in gravity feed peening systems, to make use of a system, including a shot peening gun, a bracket which is mounted upon a force sensor and a mounting base. In this case, the bracket merely acts as a buttress between the gun and the sensor. In this case, the bracket does not provide support for the nozzle because the structure and support of the nozzle is not critical to the operation of the gravity feed peening system.

Exemplary of such a prior art gravity feed peening system achieving as modicum of success in this regard is U.S. Pat. No. 4,805,429 to Thompson and assigned to the same assignee as the present invention. The Thompson patent discloses a mounting frame for a gravity feed peening system in which a sensor is disposed between the gravity feed gun and the mounting base such that the base merely supports the gun. While this system has been met with a degree of commercial success, the arrangement of the mounting base with respect to the sensor and the gun would not lend itself to be utilized in an environment where a pressure pot peening system would be employed. In a pressure pot system, unlike the gravity type, shot and air are mixed remote from the nozzle and shot is entrained in a rapidly moving air stream and passed through a hose to the nozzle. The momentum of this high velocity would effect the sensor output if the 90° bend was not provided to eliminate the component of momentum in the hose. Also, the mounting bracket probably would not provide the needed support for the critical 90° bend found in a pressure pot peening system. A more advantageous system, then, would be presented if a bracket could be developed to provide such support.

It is apparent from the above that there exists a need in the art for a pressure pot shot peening nozzle holder which is capable of measuring the shot velocity of shot peen exiting the nozzle, and which at least adequately supports the overall nozzle, but which at the same time provides support for 90° bend in the nozzle. It is purpose of this invention to fulfill this and other needs in the art in a manner more apparent to the skilled artisan once given the following disclosure.

SUMMARY OF THE INVENTION

Generally speaking, this invention fulfills these needs by providing a pressure pot peening system, comprising a bracket means having first and second legs, a sensor means having first and second sides such that said first side of said sensor is rigidly attached to said first leg of said bracket means, a gun means having a nozzle means with said gun means having first and second ends and a substantially 90° bend located intermediate of said first and second ends of said gun means such that said 90° bend is substantially located adjacent to said second side of said sensor means, said nozzle means being substantially located adjacent to said second end of gun means and said second leg of said bracket being substantially located at a predetermined distance away from said first end of said gun.

In certain preferred embodiments, the nozzle means, gun means, sensor means and bracket means are rigidly attached to form an integral structure. Also, a flexible connector hose connects said gun means to said nozzle means. Finally, the 90° bend is maintained in its orientation and rigidly secured to the sensor means by a rigid pre-formed support.

In another further preferred embodiment, substantially all of the forces experienced by the nozzle which are directed at a direction normal to the direction of flow of the shot out of the nozzle are efficiently eliminated by the unique support structure.

In particularly preferred embodiments, the nozzle holder of this invention consists essentially of a one-piece bracket having a sensor secured to one leg and one end of a peening gun tube secured to the other leg; a nozzle having a 90° bend such that one end of the 90° bend is connected to the end of the peening tube; and the 90° bend being connected adjacent to the sensor. In this way, not only are just a few pieces used to construct a rigid, integral nozzle holder, but the unique structure eliminates substantially all the forces experienced in the nozzle which are normal to the direction of flow of the shot exiting the nozzle.

The preferred holder, according to this invention offers the following advantages; lightweight, ease of assembly and repair, good force sensing characteristics; good stability; good durability; excellent nozzle/sensor alignment; good economy; high strength for safety; and excellent support characteristics. In fact, in may of the preferred embodiments, these factors of alignment and support characteristics are optimized to an extent considerably higher than heretofore achieved in prior, known nozzle holders.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figure in which the single Figure is a side elevational view substantially in cross-section of a pressure pot peening system nozzle holder according to the present invention.

DETAILED DESCRIPTION OF THE INVENTION

Referring to the single Figure there is illustrated a pressure pot peening system 2 which includes a bracket 4, sensor 8, inlet hose adaptor 18, nozzle holder 22, nozzle 34, and shot 36.

Bracket 4, preferably constructed of steel, is rigidly attached to a conventional robot arm 6, by conventional fasteners 40. Robot arm 6 provides the capability of positioning system 2 in a variety of orientations depending upon, among other things, the type of material to be peended or the surface structure of the object to be peened.

Sensor 8 is rigidly attached along one side by conventional fasteners 10 to one leg of bracket 4. Sensor 8 is a force sensor which should detect the reaction force of nozzle 34 as it ejects shot 36 and air flow path A. Force sensor 8 is connected by conventional connectors (not shown) to a signal processing circuit 44. Although other force sensors could be used, force sensor 8 is preferably a Lebow load cell Model 3397 and the signal processing circuit 44 is preferably a corresponding transducer instrument 7530-105, these two components often being sold as a package. The signal processing circuit 44 basically converts the output from force sensor 8 into a form corresponding to pounds of force such that the output may be displayed and/or recorded. Force sensor 8, preferably, operates over a range of 0–25 pounds and a resolution of 0.01 pounds.

Sensor 8 is rigidly attached by conventional fastener 14 along its other side to force sensor adapter 12, which is, preferably constructed of steel. Adapter 12 is rigidly attached by conventional fastener 26 to nozzle holder body 22.

Nozzle holder body 22 is, preferably, a one-piece construction made of any suitable ultra high molecular weight polymer. Nozzle holder body 22 is formed by well-known, conventional polymer forming techniques, for example, molding. It is to be understood that while a polymer substance is used in nozzle holder body 22, body 22 can also be constructed of or, for weight saving, line with, a suitable tungsten carbide material and formed by conventional metal forming techniques, for example, molding.

A 90° bend 25 within holder 22 and is substantially adjacent to and in alignment with sensor 8 and flow path A. Bend 25 is provided so that the entire momentum of the mass of shot and air ejected from nozzle 34 along flow path A should be sensed by sensor 8.

Located within a recess 27 in holder 22 is a retainer ring 28. Ring 28 is, preferably, constructed of steel and is formed in the shape of an O-ring. Ring 28 should act as a stop to prevent fastener 26 from adversely affecting holder 22, for example, by creating undue compression on holder 22 if fasteners 26 are tightened too much.

Located adjacent ring 28 is gasket 30. Gasket 30 is, preferably, constructed of a suitable rubber-like material and should be of such a shape and size as to substantially prevent air from seeping into threads 32 in holder 22. Also, gasket 30 should be of such a shape and size as to not adversely affect the air/shot flow through system 2.

Nozzle 34 is engaged in holder 22 by threads 32. Nozzle 34 is, preferably, constructed of the same material as holder 22. Threads 32, are preferably, $1\frac{5}{8}$–$11\frac{1}{2}$ straight pipe thread.

Connector hose 16 is placed over and in frictional contact with leg 24 of holder 22. Hose 16 is, preferably, constructed of any suitable, flexible rubber-like material. Hose 16 connects leg 24 and inlet hose adapter 18 so as to substantially provide a flexible connection between adapter 18 and leg 24. Flexible hose 16 accommodates the very small deflections of force sensor 8 when they arise due to, for example, changing reaction forces on nozzle 34. It also prevents these forces being carried to bracket 4 through adapter 18.

Adapter 18, which is, preferably, constructed of hardened tool steel is rigidly secured by conventional fasteners 38 to the other leg of bracket 4. Oversized holes 42 are provided in the leg of bracket 4 to accommodate the placement of adapter 18. Holes 42 serve as an adjustment means for adapter 18 in that once adapter 18 and leg 24 are connected by hose 16, adapter 18 can be axially aligned with leg 24 and fasteners 38 tightened so as to substantially maintain this axial alignment. Adapter 18 is attached by conventional connectors (not shown) to the rest of the pressure pot peening system.

In operation, air and shot 36 are entrained in system 2, in particular, inlet hose adapter 18 and leg 24 until they reach bend 25. The air and shot 36 are then redirected and flow out of nozzle 34 in the direction of arrow A. Prior to reaching bend 25, the air and shot 36 are flowing substantially perpendicular to the longitudinal axis of nozzle 34. Consequently, the momemtum of the incoming air/shot stream should not be sensed. After the air/shot change direction, due to bend 25, the momemtum of the exiting air/shot stream should be sensed. The force of this momemtum being determined yb well known force calculation methods.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A pressure pot shot peening system which is comprised of:

a supply means for supplying a mass of shot and air to a gun means;

a bracket means having first and second legs;

a sensor means operable to sense a reaction force from operation of said pressure pot peening system said sensor means having first and second sides such that said first side of said sensor means is rigidly attached to said first leg of said bracket means;

a gun means having a nozzle means with said gun means having first and second ends such that said mass of shot and air are conveyed from said first end through said second end and ejected from said nozzle means to create a reaction force parallel to said nozzle means and said gun means and a substantially 90° bend having first and second legs and being located intermediate of said first and second ends of said gun means such that saidfirst leg of said 90° bend is substantially located parallel to said second side of said sensor means and said second leg of said 90° bend is substantially perpendicular to said second side of said sensor means so that substantially the entire reaction force of the mass of shot and air ejected from said nozzle means is sensed by said sensor means and said second leg of said bracket being substantially located at a predetermined distance away from said first end of said gun means.

2. The pressure pot peening system, according to claim 1, wherein said gun means and said supply means are connected by a flexible hose means.

3. The pressure pot peening system, according to claim 1, wherein said bracket means is rigidly connected to a system moving means such that said system moving means orients said pressure pot peening system in a variety of predetermined positions and locations.

4. The pressure pot peening system, according to claim 1, wherein said bracket means is further comprised of:

at least one oversized hole substantially located on said second leg of said bracket means.

5. The pressure pot peening system, according to claim 4, wherein said gun means is rigidly attached to said bracket means substantially through said oversized hole.

6. A pressure pot shot peening system which is comprised of:

a bracket means having first and second legs;

a supply means for supplying a mass of shot and air to a gun means;

a sensor means operable to sense a reaction force from operation of said peening system said sensor means having first and second sides such that said first side of said said sensor means is rigidly attached to said first leg of said bracket means;

a gun means having a nozzle means substantially co-linear with said sensor means with said gun means having first and second ends such that said mass of shot and air are conveyed from said first end through said second end and ejected from said nozzle means to create a reaction force co-linear to said nozzle means and said gun means and a substantially 90° bend having first and second legs and being located intermediate of said first and second ends of said gun means such that said second leg of said 90° bend is substantially located co-linear to said second side of said sensor means so that substantially the entire reaction force of the mass of shot and air ejected from said nozzle means is sensed by said sensor means and said second leg of said bracket being substantially located at predetermined distance away form said first end of said gun means.

* * * * *